US008845340B2

(12) United States Patent
Nakanishi

(10) Patent No.: US 8,845,340 B2
(45) Date of Patent: Sep. 30, 2014

(54) CONNECTOR AND ELECTRICAL CONNECTION BOX

(75) Inventor: Ryuji Nakanishi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 172 days.

(21) Appl. No.: 13/516,366

(22) PCT Filed: Mar. 23, 2011

(86) PCT No.: PCT/JP2011/056878

§ 371 (c)(1),
(2), (4) Date: Jun. 15, 2012

(87) PCT Pub. No.: WO2011/155245

PCT Pub. Date: Dec. 15, 2011

(65) Prior Publication Data

US 2012/0258619 A1 Oct. 11, 2012

(30) Foreign Application Priority Data

Jun. 7, 2010 (JP) ..... 2010-129998

(51) Int. Cl.
*H01R 12/00* (2006.01)

(52) U.S. Cl.
USPC ..... 439/76.1; 439/76.2

(58) Field of Classification Search
USPC ..... 439/76.1, 535, 76.2
See application file for complete search history.

(56) References Cited

U.S. PATENT DOCUMENTS

| | | | | |
|---|---|---|---|---|
| 6,527,989 | B1 | 3/2003 | Onoda | |
| 7,357,650 | B2 * | 4/2008 | Sasaki et al. | 439/76.2 |
| 7,699,622 | B2 * | 4/2010 | Sakamoto | 439/76.1 |
| 7,736,158 | B2 * | 6/2010 | Yamaguchi | 439/76.2 |
| 7,931,478 | B2 * | 4/2011 | Yamaguchi | 439/76.1 |
| 2007/0164475 | A1 | 7/2007 | Nagashima et al. | |
| 2009/0298311 | A1 * | 12/2009 | Nakanishi et al. | 439/76.2 |

FOREIGN PATENT DOCUMENTS

| | | |
|---|---|---|
| JP | A-2000-252038 | 9/2000 |
| JP | A-2001-238327 | 8/2001 |
| JP | A-2007-190777 | 8/2007 |
| JP | A-2009-291043 | 12/2009 |

OTHER PUBLICATIONS

May 31, 2011 International Search Report issued in PCT Application No. PCT/JP2011/056878 (with translation).

* cited by examiner

*Primary Examiner* — Hien Vu
(74) *Attorney, Agent, or Firm* — Oliff PLC

(57) ABSTRACT

An electrical connection box is provided with a case which accommodates a circuit board on the interior thereof. The case has a connector provided with a synthetic resin section on which a terminal fitting connected to the circuit board is arranged. The synthetic resin section has a hood section with which a partner connector is engaged, a surrounding wall which is provided on the periphery of the hood section and forms a cavity between the surrounding wall and hood section, a locking section provided on the inner wall of the hood section, and a reinforcing rib which is provided on an area of the hood section corresponding to the locking section.

14 Claims, 9 Drawing Sheets

[図8]

CONNECTOR AND ELECTRICAL CONNECTION BOX

BACKGROUND

The present application is a national phase of PCT/JP2011/056878, filed Mar. 23, 2011, which claims priority to Japanese Patent Application No. 2010-129998, filed Jun. 7, 2010.

The exemplary embodiments described herein detail for illustrative purposes and are subject to many variations in structure and design. It should be emphasized, however, that the present invention is not limited to a particularly disclosed embodiment shown or described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The terms "a" and "an" herein do not denote a limitation of quantity, but rather denote the presence of at least one of the referenced item.

This disclosure generally relates to a connector and an electric connection box.

In the related art, an electric connection box provided with a connector described in Patent Document 1 is known. This electric connection box includes a circuit board stored in a case. The case is provided with an opening, and a connector, having a hood portion, which can be fitted to a mating connector, is arranged in the opening. Formed on an inner wall of the hood portion is a locking portion which is locked with the mating connector.

The case is provided with a surrounding wall which configures having an opening and a cavity portion formed between the surrounding wall and the hood portion. The surrounding wall described above is configured to surround an outer periphery of the hood portion.

Water adhered on an outer surface of the case flows down on the outer surface of the case by the hood portion surrounded by the surrounding wall, and is adhered on the surrounding wall. Since the cavity portion is formed between the surrounding wall and the hood portion, the water adhered to the surrounding wall can be inhibited from adhering directly on the outside of the hood portion. Accordingly, the water can be inhibited from moving from the outside of the hood portion to the inside of the hood portion.

Patent Document 1: JP-A-2009-291043

SUMMARY

However, according to the configuration as described above, the cavity portion is formed between the hood portion and the surrounding wall. Therefore, in a state in which the mating connector is fitted into the hood portion, there is fear that an area of the hood portion where the locking portion is formed is subjected to a flexural deformation toward the surrounding wall. This may result in displacement of the locking portion away from the mating connector, and hence there is fear that the lock between the locking portion and the mating connector can easily be released.

In view of such circumstances described above, it is an object of the preferred embodiments to provide a connector which firmly locks the mating connector and an electric connection box.

Preferred embodiments provide a connector including: a terminal fitting and a synthetic resin portion having the terminal fitting disposed therein, wherein the synthetic resin portion includes: a hood portion to which a mating connector is fitted; a surrounding wall provided on an outer periphery of the hood portion and forming a cavity portion with the hood portion; a locking portion provided on an inner wall of the hood portion and configured to lock the mating connector from the back side of the mating connector with respect to the fitting direction to restrict the mating connector from separating from the hood portion backward with respect to the fitting direction; and a reinforcing rib provided in an area of the hood portion corresponding to the locking portion and configured to connect the hood portion and the surrounding wall.

Also, preferred embodiments provide an electric connection box comprising a circuit board, a case configured to store the circuit board in the interior thereof, wherein the case includes a connector having a terminal fitting connected to the circuit board and a synthetic resin portion having the terminal fitting disposed therein; the synthetic resin portion includes: a hood portion to which a mating connector is fitted; a surrounding wall provided on an outer periphery of the hood portion and forming a cavity portion with the hood portion; a locking portion provided on an inner wall of the hood portion and configured to lock the mating connector from the back side of the mating connector with respect to the fitting direction to restrict the mating connector from separating from the hood portion backward with respect to the fitting direction; a reinforcing rib provided in an area of the hood portion corresponding to the locking portion and configured to connect the hood portion and the surrounding wall.

According to the preferred embodiments, in the state in which the mating connector is fitted into the hood portion, the area of the hood portion corresponding to the locking portion is inhibited from being subject to the flexural deformation toward the surrounding wall. Accordingly, robust locking between the locking portion and the mating connector is achieved. Consequently, according to the present invention, robust locking between the connector and the mating connector is achieved.

REFERENCE NUMERALS

Figure 1:
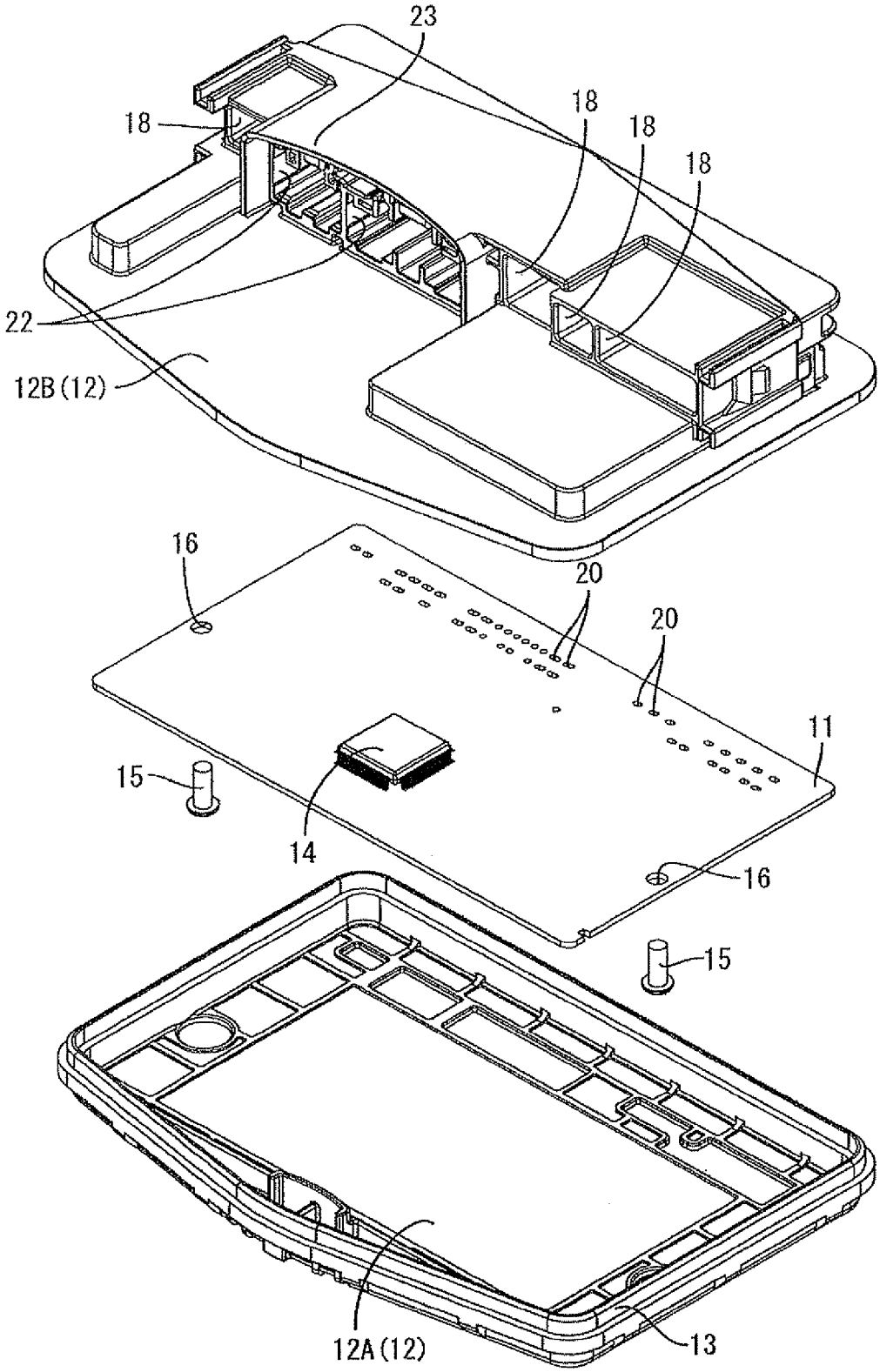
FIG. 1 is an exploded perspective view showing an electric connection box according to a preferred embodiment.

10 . . . electric connection box
11 . . . circuit board
12 . . . case
12A . . . first case
12B . . . second case
13 . . . welding rib
14 . . . electronic component
15 . . . bolts
16 . . . bolt insertion holes
17 . . . bosses
18 . . . connector hood portions
19A, 19B . . . terminal fitting
20 . . . through holes
21 . . . connector
22 . . . hood portion
23 . . . surrounding wall
24 . . . synthetic resin portion
25 . . . cavity portion
26 . . . mating connector
27 . . . locking portion
28 . . . locking projection
29 . . . depressed portion
30 . . . electric wires
31 . . . female terminal fittings
32 . . . first synthetic resin material
33 . . . primary molded portion
34 . . . second synthetic resin material
35 . . . secondary molded portion
36 . . . base wall
37 . . . extending strip
38 . . . reinforcing rib
9 . . . second mold
40 . . . mold abutting surface
41 . . . first mold

DETAILED DESCRIPTION OF EMBODIMENTS

An exemplary apparatus for an electrical junction box is described herein. The present specification discloses the components and various exemplarily methods of manufacturing the components for their application and implementation. In the following description, for purposes of explanation, numerous specific details are set forth in order to provide a thorough understanding of the disclosed electrical junction box. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places of the specification are not necessarily all referring to the same embodiment.

Figure 2:
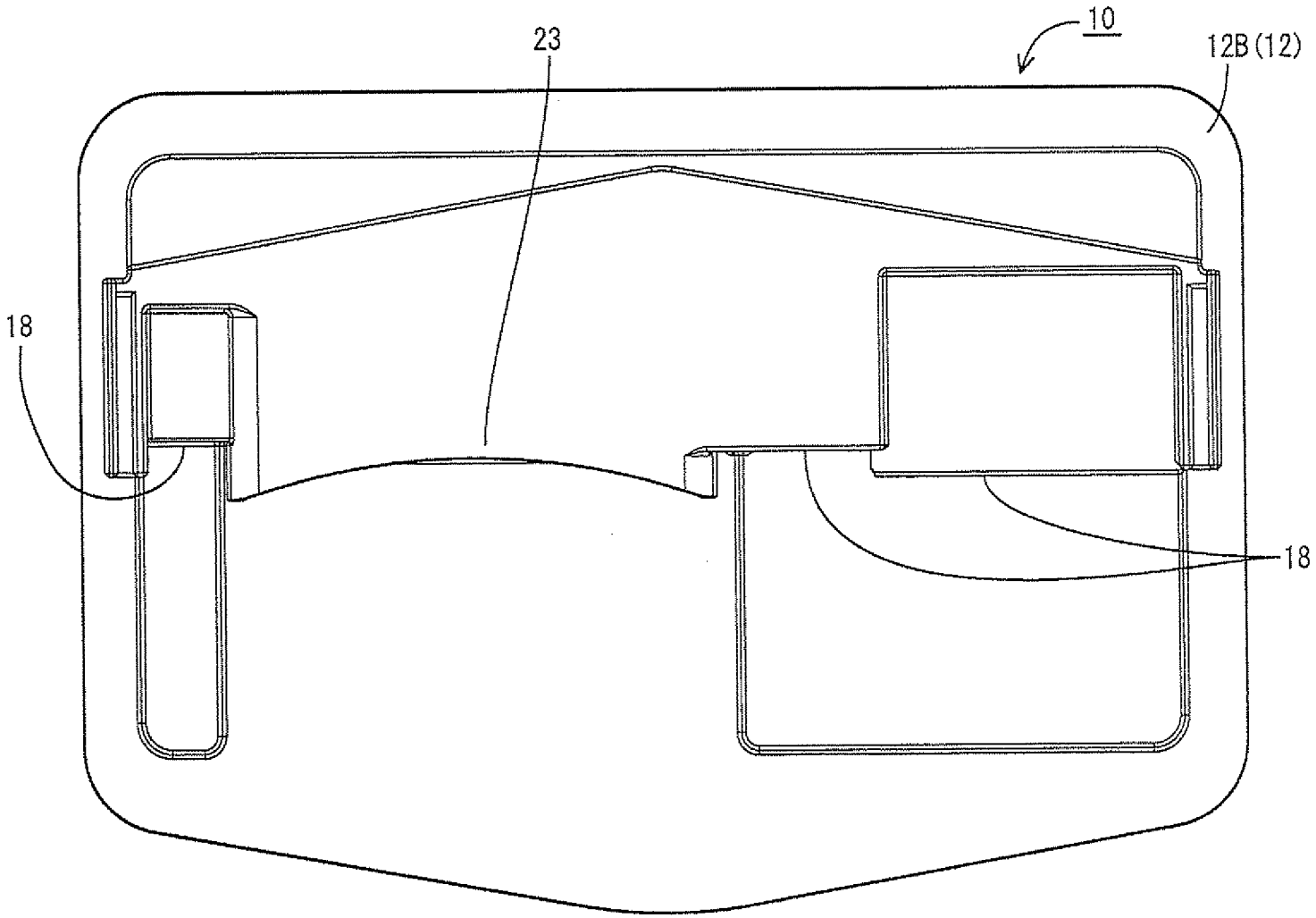
FIG. 2 is a front view showing the electric connection box.
Figure 3:
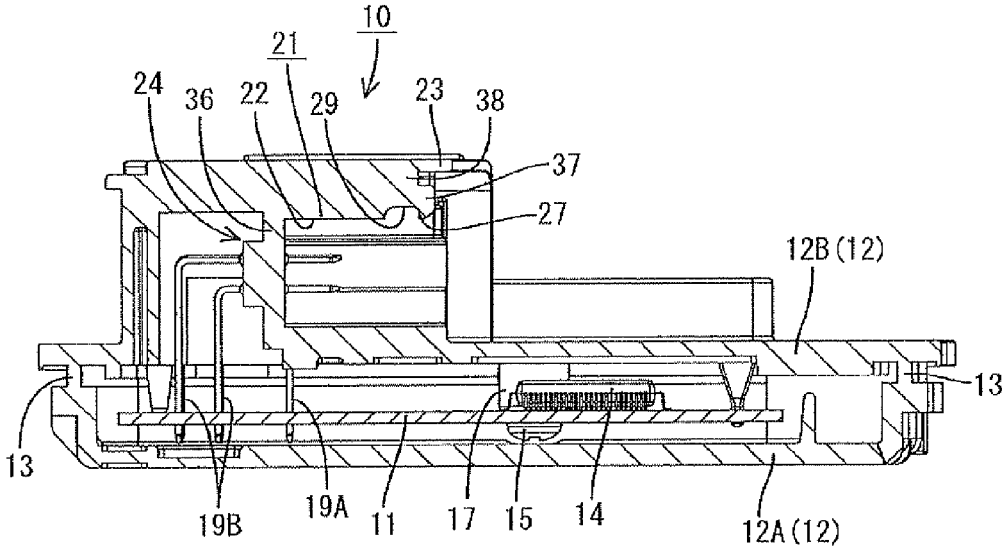
FIG. 3 is a cross-sectional view taken along the line in FIG. 5.

Referring now to FIG. 1 to FIG. 11, an embodiment in which the present invention is applied to an electric connection box 10 for a vehicle will be described. The electric connection box 10 according to the embodiment includes a circuit board 11, and a case 12 configured to allow storage of the circuit board 11 therein. In the following description, the left in FIG. 2 is defined as the left side and the right therein is defined as the right side. Also, the upper side in FIG. 2 is defined as the upper side and the down side therein is defined as the down side. Also, the upper side in FIG. 3 is defined as the front side and the lower side is defined as the back side.

(Case 12)

As shown in FIG. 2, the case 12 is formed of a synthetic resin and is formed into a substantially pentagon shape when viewed from the front and back direction (the direction penetrating through the paper plane in FIG. 2). As shown in FIG. 1, the case 12 includes a first case 12A which is formed into a shallow dish-shape opening toward the front side (the upper side in FIG. 1) and a second case 12B attached to the first case 12A from the front side and configured to close the opening of the first case 12A.

Formed on an opening edge portion of the first case 12A is a welding rib 13 projecting toward the front side and formed into a closed loop shape. When the second case 128 is assembled to the first case 12A, a projecting end edge of the welding rib 13 comes into abutment with an opening edge portion of the second case 12B from the back side. By applying oscillations to the first case 12A and the second case 12B in this state, the welding rib 13 of the first case 12A is oscillatory welded to the second case 12B. Since the welding rib 13 is formed into a closed loop shape as described above, the abutting surfaces between the first case 12A and the second case 12B are in a state of tight contact over the entire circumference without any disconnection. Accordingly, the first case 12A and the second case 12B are secured in a liquid-tight manner.

(Circuit Board 11)

Stored in the case 12 is the circuit board 11 formed into a substantially rectangular shape. Formed on one or both of the front surface and the back surface of the circuit board 11 is a power conductive path, not shown, by print wiring technology. An electronic component 14 is connected to this power conductive path with a known technology such as soldering.

Formed on the circuit board 11 is bolt insertion holes 16 which allow insertion of bolts 15 (see FIG. 1). Also, as shown in FIG. 3, bosses 17 having screw holes (not shown) are formed on the back surface of the second case 12B so as to project therefrom. The circuit board 11 is fixed to the second case 12B by the bolts 15 inserted from the back side (the lower side in FIG. 3) into the bolt insertion holes 16 and screwed into screw holes of the bosses 17.

(Connector Hood Portion 18)

As shown in FIG. 2, a plurality of (three in the embodiment) connector hood portions 18 opening downward are formed on an area of a substantially upper half of the second case 12B and also of a substantially right half thereof. The connector hood portions 18 are formed into a substantially square cylindrical shape. As shown in FIG. 3, terminal fittings 19A formed into a tab-shape are disposed in the connector hood portions 18. The terminal fittings 19A project through the connector hood portions 18 into the case 12, and are then bent toward the circuit board 11. End portions of the terminal fittings 19A bent toward the circuit board 11 are inserted into through holes 20 formed on the circuit board 11 and are connected to the power conductive path by a known method such as soldering.

Also, one connector hood portion 18 opening downward is formed in an area of the substantially upper half of the second case 1213 and also close to the left end portion thereof. In the same manner as described above, a terminal fitting 19A disposed in this connector hood portion 18 is also connected to the circuit board 11.

(Connector 21)

As shown in FIG. 2, a surrounding wall 23 opening downward and configured to store hood portions 22 (described later) in the interior thereof is formed on an area of a substantially upper half of the second case 12B and also of a substantially left half thereof. The surrounding wall 23 is formed into a substantially inverted angular U-shape, and allows storage of the connectors 21 in the interior thereof. In the embodiment, two hood portions 22 are disposed side by side in the lateral direction (the lateral direction in FIG. 5) in the interior of the surrounding wall 23.

The connector 21 includes terminal fittings 19B formed into a tab shape, and a synthetic resin portion 24 formed of a synthetic resin having the terminal fittings 19B disposed therein. The second case 12B and the synthetic resin portion 24 of the connector 21 are formed integrally. In other words, the synthetic resin portion 24 of the connector 21 is formed integrally with the surrounding wall 23 of the second case 12B.

Figure 4:
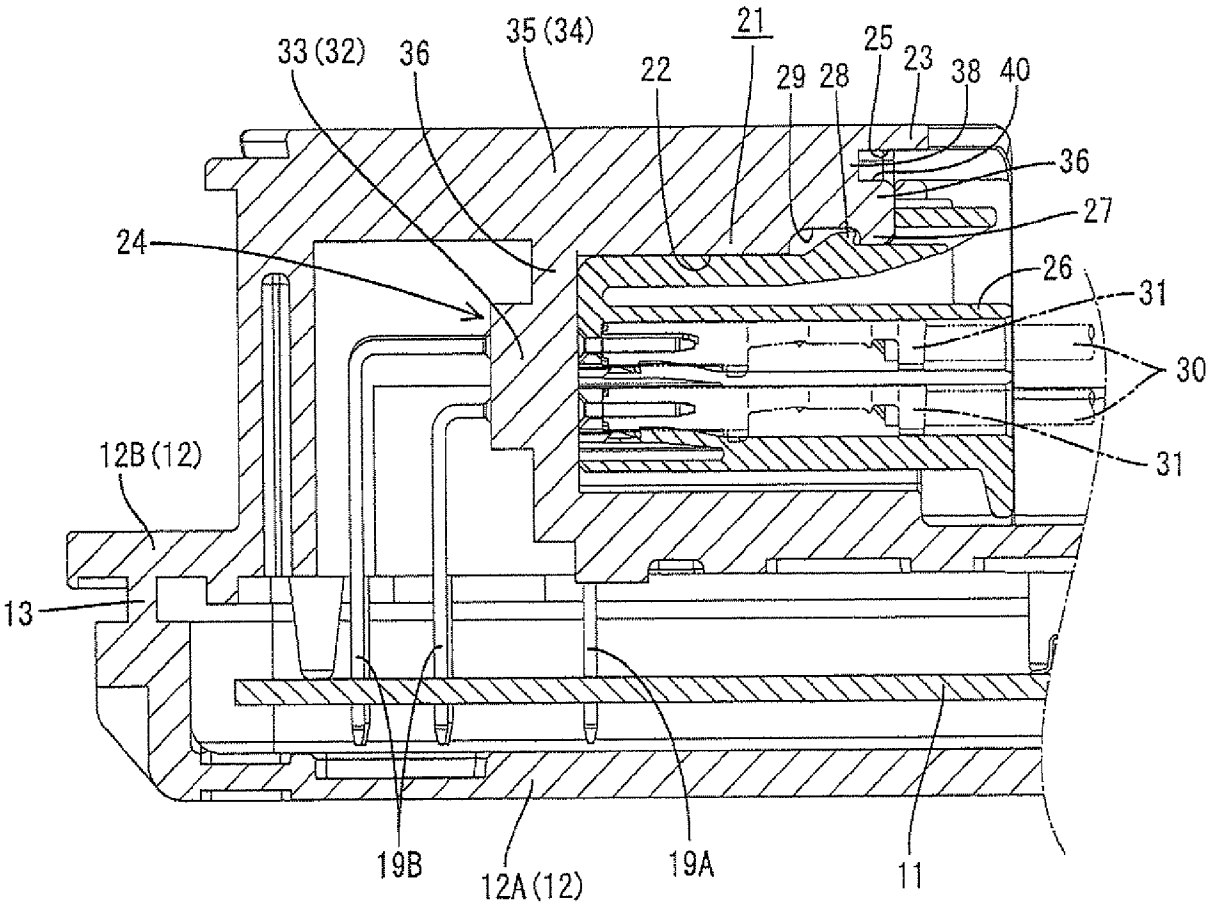
FIG. 4 is an enlarged cross-sectional view showing a principal portion in a state in which a mating connector is fitted into a hood portion.
Figure 5:
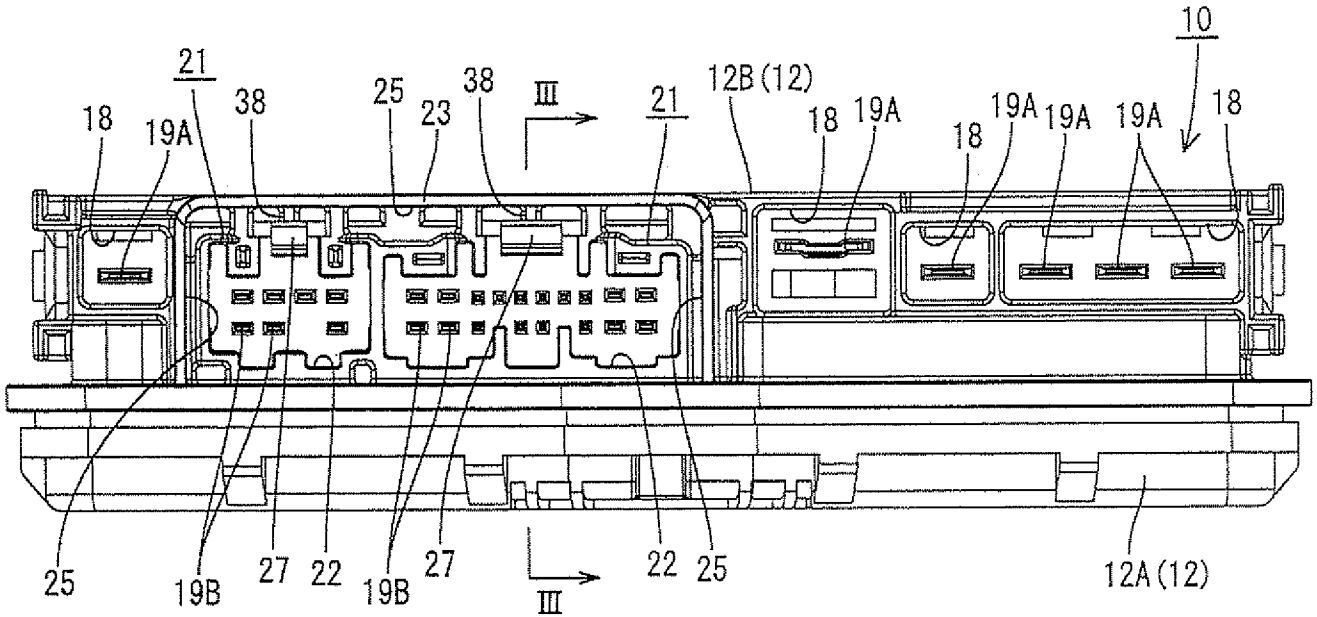
FIG. 5 is a bottom view showing the electric connection box.

As shown in FIG. 3 to FIG. 5, the synthetic resin portion 24 includes the hood portion 22 to which mating connector 26 is fitted. Each of the hood portions 22 is formed into a substantially square cylindrical shape. As described above, provided on an outer periphery of the hood portion 22 is the surrounding wall 23 which surrounds the hood portion 22. The hood portion 22 and the surrounding wall 23 are formed at a predetermined distance, and a cavity portion 25 is formed between the hood portion 22 and the surrounding wall 23. The cavity portion 25 is formed between the hood portions 22 and the surrounding wall 23 in the lateral direction of the hood portions 22 (the lateral direction in FIG. 5), and between the hood portions 22 and the surrounding wall 23 in the front and back direction of the hood portions 22 (the vertical direction in FIG. 5).

Formed on an inner wall (the wall surface opposing the terminal fittings 19B) of the hood portions 22 are locking portions 27 which are locked with the mating connectors 26. As shown in FIG. 4, the locking portions 27 are configured to restrict the mating connectors 26 from being disconnected in the backward direction with respect to the fitting direction (the rightward direction in FIG. 4) by locking the locking projections 28, which project from the mating connectors 26 from the back side with respect to the fitting direction of the mating connectors 26 (the right side in FIG. 4).

The locking projection 28 of each of the mating connector 26 is configured to be stored in a depressed portion 29 formed on the inner wall of the hood portion 22 so as to be depressed therefrom in a state in which the mating connector 26 is normally fitted into the hood portion 22. The locking portion 27 described above is formed on the wall portion located on the back side with respect to the direction of fitting the mating connector 26 from among the wall portions which define the depressed portion 29.

Female terminal fittings 31 connected to the terminals of electric wires 30 are stored in the mating connector 26. The female terminal fittings 31 and the terminal fittings 19B disposed in the hood portion 22 are connected to each other, so that the terminal fittings 19B and the electric wires 30 are electrically connected.

The synthetic resin portion 24 of the connector 21 includes a primary molded portion 33 formed of a first synthetic resin material 32, and a secondary molded portion 35 formed by molding the primary molded portion 33 further with a second synthetic resin material 34. In the embodiment, the first synthetic resin material 32 and the second synthetic resin material 34 are formed of the same synthetic resin. Therefore, the primary molded portion 33 and the secondary molded portion 35 are integrally secured, so that a boundary portion between the primary molded portion 33 and the secondary molded portion 35 cannot be distinguished clearly. Also, the first synthetic resin material 32 and the second synthetic resin material 34 may be formed of different synthetic resin materials.

Figure 8:
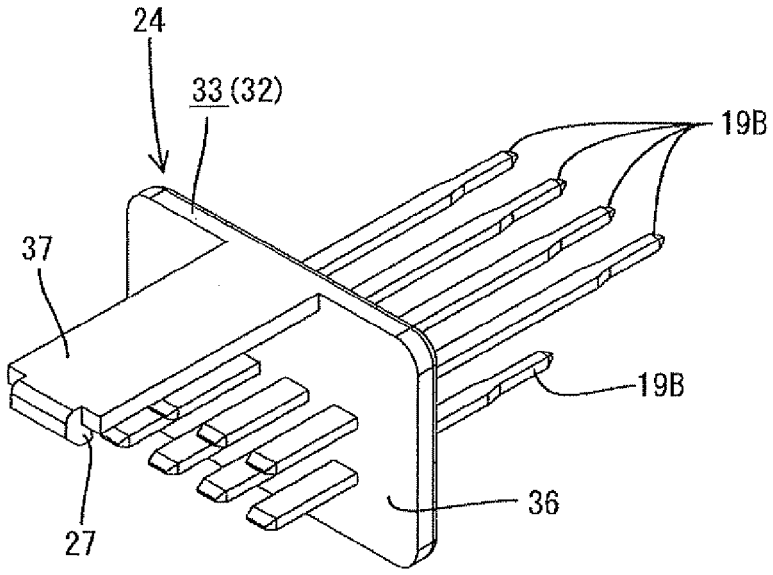
FIG. 8 is a perspective view showing the primary molded portion.
Figure 9:
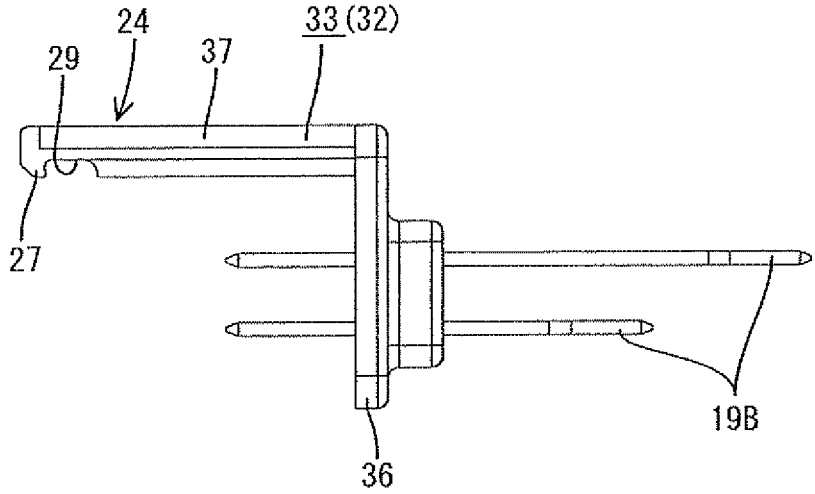
FIG. 9 is a side view showing the primary molded portion.

As shown in FIG. 8 and FIG. 9, the primary molded portion 33 includes a base wall 36 through which the plurality of terminal fittings 1913 penetrate therethrough, and an extending strip 37 formed of a plate shape that extends from the position closer to the end portion of the base wall 36 in the direction orthogonal to the base wall 36 in which the terminal fittings 1913 penetrating through the base wall 36 extend. Formed at an end portion of the extending strip 37 are the depressed portion 29 and the locking portions 27 described above.

As shown in FIG. 3, end portions of the terminal fittings 19B penetrating through the base wall 36 are bent at a right angle toward the circuit board 11, and are inserted into the through holes 20 formed on the circuit board 11, and are connected to the power conductive paths of the circuit board 11 by a known method such as soldering.

The secondary molded portion 35 is formed so as to be secured to the base wall 36 and the extending strip 37 of the primary molded portion 33, so that the hood portions 22, the surrounding wall 23, and the second case 12B described above are formed. In other words, the surrounding wall 23, and the second case 1213 are formed integrally with the connectors 21 as the secondary molded portion 35.

(Reinforcing Rib 38)

Figure 6:
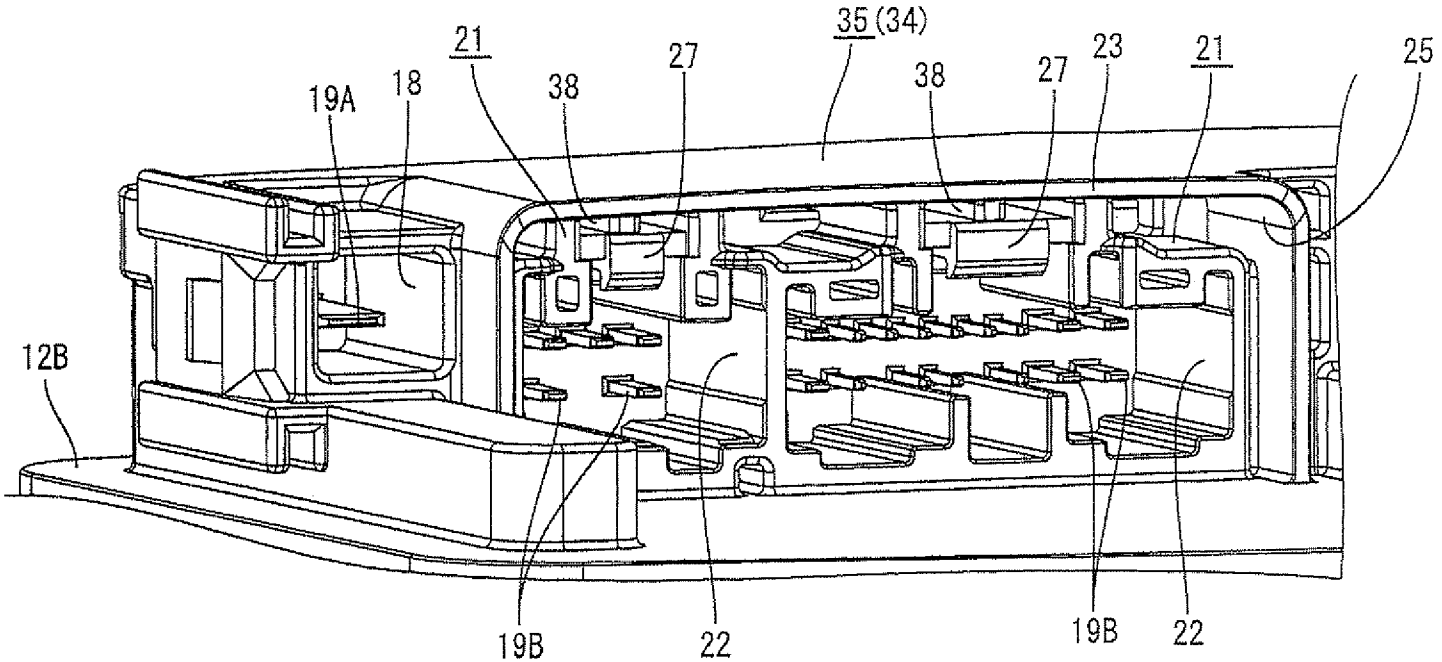
FIG. 6 is an enlarged perspective view showing a principal portion of a reinforcing rib.

As shown in FIG. 5 and FIG. 6, in areas of the hood portions 22 corresponding to the locking portions 27, reinforcing ribs 38 which connect the hood portions 22 and the surrounding wall 23 are formed so as to extend in the vertical direction (the direction penetrating through the paper plane in FIG. 5). The reinforcing ribs 38 are formed on the secondary molded portion 35 described above. In the embodiment, one reinforcing rib 38 is formed for one locking portion 27.

As shown in FIG. 4, each of the reinforcing ribs 38 is formed at a position retracted from a distal end edge of the extending strip 37 (the hood portions 22). More specifically, the distal end edge of the reinforcing rib 38 is formed at a position slightly retracted leftward in FIG. 4. Accordingly, a mold abutting surface 40, where a second mold 39 used when forming the secondary molded portion 35 abuts, is formed in an area of the hood portion 22 corresponding to the extending strip 37 and on the wall surface on the side of the surrounding wall 23.

(Manufacturing Process)

Subsequently, an example of the manufacturing process of the electric connection box 10 according to the embodiment will be described. First of all, a process of manufacturing the second case 12B will be described. The second case 12B is formed by executing a first process for forming the primary molded portion 33 using the first synthetic resin material 32, and a second process for forming the secondary molded portion 35 by further molding the primary molded portion 33 using the second synthetic resin material 34.

(First Process)

First of all, a pair of first molds 41A, 41B are opened. The terminal fittings 19B are placed on a predetermined position on the first mold 41A which is one of the pair of first molds 41A, 41B. Subsequently, the other first mold 41B is clamped, and the liquid-state first synthetic resin material 32 is injected into a cavity formed in the interior of the first mold 41 (see FIG. 7).

Figure 7:
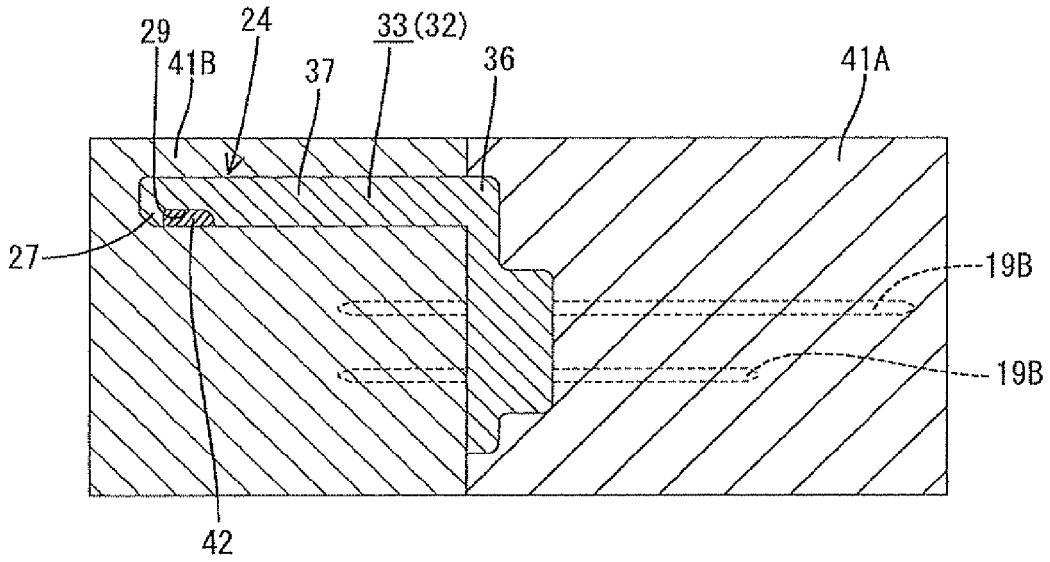
FIG. 7 is a cross-sectional view showing a primary molded portion in a first process.

The first molds 41A, 41B described above are formed to be opened along the lateral direction in FIG. 7 (the direction in which the extending strip 37 extends). In a state in which the first molds 41A, 41B are clamped, a slide core 42, which slides in the direction parallel to the board surface of the extending strip 37, which is the direction orthogonal to the direction in which the extending strip 37, extends is disposed in an area of the cavity where the depressed portion 29 is formed. The extending strip 37 and the locking portion 27 are formed by injecting the first synthetic resin material 32 into a cavity positioned between the slide core 42 and the first molds 41A, 41B.

After the first synthetic resin material 32 injected into the cavity has solidified and the extending strip 37 has formed, the slide core 42 is slid and the slide core 42 is separated from the primary molded portion 33. Subsequently, the first molds 41A, 41B are opened, and the primary molded portion 33 is separated from the first molds 41A, 41B.

(Second Process)

Subsequently, the second mold 39 is opened and the primary molded portion 33 is placed at a predetermined position. Then, the second mold 39 is clamped. Subsequently, the second synthetic resin material 34 is injected into the cavity defined between the primary molded portion 33 and the second mold 39 to form the secondary molded portion 35.

Figure 10:
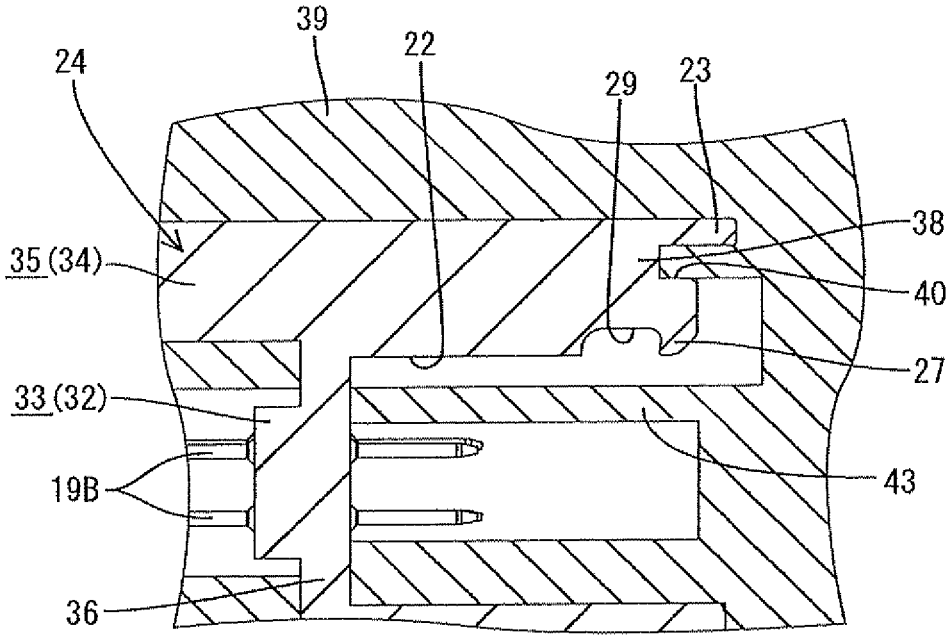
FIG. 10 is an enlarged cross-sectional view showing a principal portion of a secondary molded portion in a second process.

In the second process, the second mold 39 is configured to partially abut with the primary molded portion 33. Accordingly, the second synthetic resin material 34 is prevented from flowing into an area surrounded by the second mold 39 and the primary molded portion 33. For example, as shown in FIG. 10, the second mold 39 is formed with a restricting wall 43 which restricts the second synthetic resin material 34 from being adhered to the locking portion 27. An end edge of the restricting wall 43 comes into abutment with the base wall 36, and the second mold 39 comes into abutment with the mold abutting surface 40, so that the entry of the second synthetic resin material 34 into the space surrounded by the second mold 39 and the primary molded portion 33 is restricted, and the adhesion of the second synthetic resin material 34 to the locking portion 27 is restricted in the second process.

In the above-described process, as shown in FIG. 10, the second mold 39 is configured to come into abutment with the mold abutting surface 40 of the extending strip 37. Accordingly, formation of the gap between the extending strip 37 and the second mold 39 is inhibited. Consequently, when forming the reinforcing ribs 38, the second synthetic resin material 34 for forming the reinforcing ribs 38 is prevented from leaking from the gap between the extending strip 37 and the second mold 39 and from forming weld flash.

Figure 11:
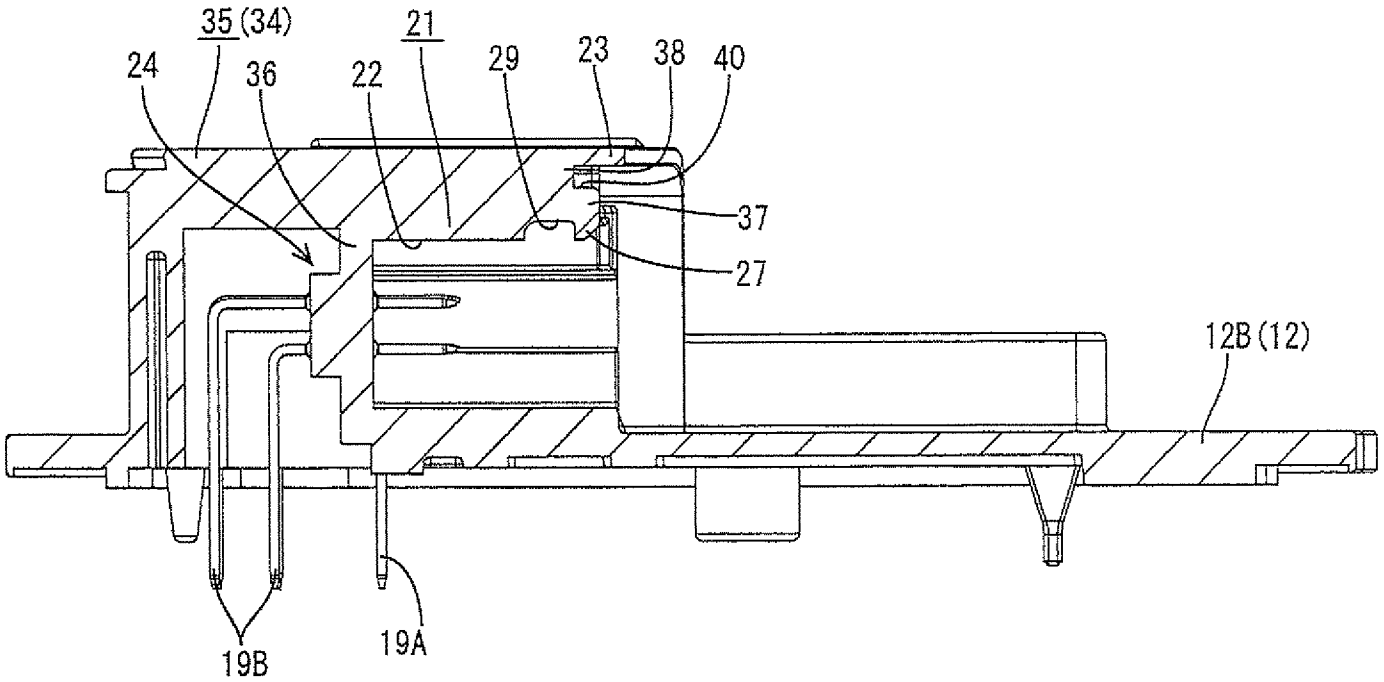
FIG. 11 is a cross-sectional view showing a second case.

After the second synthetic resin material 34 has solidified, the second mold 39 is opened, and the second case 12B is separated from the second mold 39. Accordingly, as shown in FIG. 11, the second case 12B is formed.

Subsequently, the circuit board 11 on which the electronic component 14 is mounted is secured to the back surface of the second case 12B with bolts. At this time, the terminal fittings 19A, 19B are caused to be inserted into the through holes 20 of the circuit board 11. Subsequently, the terminal fittings 19A, 19B and the through holes 20 are connected, for example, by a known method such as flow soldering or the like.

Then, by applying oscillation to the first case 12A and the second case 1213 in a state in which the welding rib 13 of the first case 12A and the opening edge of the second case 12B are in abutment, the first case 12A and the second case 1213 are welded by oscillatory welding. Accordingly, the electric connection box 10 is completed.

(Operations and Effects)

Subsequently, the operations and the effects of the embodiment will be described. In the embodiment, since the cavity portion 25 is formed between the hood portions 22 and the surrounding wall 23, even when water adhered to the outer surface of the case 12 flows to the surrounding wall 23, the water is inhibited from adhering directly to the hood portions 22. Consequently, entry of the water into the interior of the hood portions 22 and adhesion to the terminal fittings 19B thereby is inhibited.

Also, according to the embodiment, the reinforcing ribs 38, which connect the hood portions 22 and the surrounding wall 23, are formed in an area of the hood portion 22 corresponding to the locking portion 27. With the provision of the reinforcing ribs 38, a flexural deformation of at least an area of the hood portions 22 corresponding to the locking portion 27 toward the surrounding wall 23 side in a state in which the mating connector 26 is fitted into the hood portion 22 is inhibited. Accordingly, the flexural deformation of the hood portion 22, in the direction in which the locking structure between the locking portion 27 of the hood portions 22 and the locking projection 28 of the mating connectors 26 is released, is inhibited, and hence the locking portion 27 and the mating connectors 26 can be firmly locked.

Also, in the embodiment, the depressed portion 29, in which the locking projection 28 formed on the mating connector 26 is stored in a state in which the mating connector 26 is fitted thereto, is formed so as to be depressed on the inner wall of each of the hood portion 22. Then, the locking portion 27 is formed on the wall portion located on the back side with respect to the direction of fitting the mating connector 26 from among the wall portions which define the depressed portion 29. Accordingly, the thickness of the hood portion 22 is relatively thinner only in the area where the depressed portion 29 is formed. In other words, the thickness in the area different from the depressed portion 29 of the hood portion 22 is thicker than the area where the depressed portion 29 is formed. Consequently, since the locking portion 27 can be formed without reducing the rigidity of the hood portion 22, the flexural deformation of the hood portion 22 toward the surrounding wall 23 can further be inhibited.

Also, in the embodiment, each of the hood portions 22 includes the extending strip 37 of the primary molded portion 33 and the secondary molded portion 35 secured to the extending strip 37. The extending strip 37 is formed with the locking portion 27 which is locked with the mating connectors 26. When the mating connector 26 is fitted into the interior of the hood portion 22, the mating connector 26 is locked with the locking portion 27. At this time, a force in the direction to cause the extending strip 37 to be flexurally deformed toward the surrounding wall 23 from the mating connector 26 may be applied to the extending strip 37 formed with the locking portion 27. Then, there is a concern that a force is applied to a secured portion between the primary molded portion 33 and the secondary molded portion 35, and hence the secured portion may become broken.

Therefore, in the embodiment, the reinforcing rib 38 is configured to connect the area of the extending strip 37 corresponding to the locking portion 27 and the surrounding wall 23. Accordingly, the primary molded portion 33 having the extending strip 37 and the secondary molded portion 35 having the surrounding wall 23 can be connected with the reinforcing rib 38, so that the secured portion between the primary molded portion 33 and the secondary molded portion 35 is inhibited from being broken.

Also, in the embodiment, by forming the reinforcing rib 38 at a position retracted from the distal end edge of the extending strip 37, the wall surface of the extending strip 37 on the side of the surrounding wall 23 is formed with the mold abutting surface 40 where the second mold 39, used when forming the secondary molded portion 35, and the extending strip 37 come into abutment. Accordingly, when forming the secondary molded portion 35, the extending strip 37 as the primary molded portion 33 and the second mold 39 for the secondary molding may be brought into abutment with each other on the mold abutting surface 40. Accordingly, the second synthetic resin material 34 is inhibited from leaking from the gap between the extending strip 37 and the second mold 39 at the time of the secondary molding.

Also, in the embodiment, the second case 12B is formed integrally with the connectors 21 as the secondary molded portion 35. Accordingly, the connectors 21 and the case 12 are formed integrally as the secondary molded portion 35, and hence entry of water from a gap between the connectors 21 and the case 12 is inhibited.

The present invention is not limited to the embodiment described above in the description and the drawings, and embodiments given below, for example, are also included in the technical scope of the present invention.

(1) In the embodiment, the locking portion 27 is formed by forming the depressed portion 29 on the extending strip 37. However, the invention is not limited thereto, and the locking portion 27 may be formed so as to project inward from the inner wall of the hood portion 22.

(2) In the embodiment, the second case 12B and the connectors 21 are integrally formed as the secondary molded portion 35. However, the invention is not limited thereto, and the second case 12B and the connectors 21 may be separate members.

(3) In the embodiment, the synthetic resin portion 24 includes the primary molded portion 33 and the secondary molded portion 35. However, the invention is not limited thereto, and the synthetic resin portion 24 may be formed by executing the molding process once. Also, a configuration in which the formation is achieved by executing the molding process three times or more is also applicable.

(4) In the embodiment, the reinforcing rib 38 is formed at a position retracted from the distal end edge of the extending strip 37. However, the invention is not limited thereto, and the reinforcing rib 38 may be formed to be flush with the distal end edge of the extending strip 37. Accordingly, the area of the hood portion 22 where the locking portion 27 is formed may be reinforced robustly.

(5) In the embodiment, one reinforcing rib 38 is formed for one locking portion 27. However, the invention is not limited thereto and two or more reinforcing ribs 38 may be formed for one locking portion 27.

(Means for Solving the Problems)

A technology disclosed in this specification is a connector including: a terminal fitting and a synthetic resin portion having the terminal fitting disposed therein, wherein the synthetic resin portion includes: a hood portion to which a mating connector is fitted; a surrounding wall provided on an outer periphery of the hood portion and forming a cavity portion with the hood portion; a locking portion provided on an inner wall of the hood portion and configured to lock the mating connector from the back side of the mating connector with respect to the fitting direction to restrict the mating connector from separating from the hood portion backward with respect to the fitting direction; and a reinforcing rib provided in an area of the hood portion corresponding to the locking portion and configured to connect the hood portion and the surrounding wall.

Also, a technology disclosed in this specification is an electric connection box including a circuit board, a case configured to store the circuit board in the interior thereof, wherein the case includes a connector having a terminal fitting connected to the circuit board and a synthetic resin portion having the terminal fitting disposed therein; the synthetic resin portion includes: a hood portion to which a mating connector is fitted; a surrounding wall provided on an outer periphery of the hood portion and forming a cavity portion with the hood portion; a locking portion provided on an inner wall of the hood portion and configured to lock the mating connector from the back side of the mating connector with respect to the fitting direction to restrict the mating connector from separating from the hood portion backward with respect to the fitting direction; a reinforcing rib provided in an area of the hood portion corresponding to the locking portion and configured to connect the hood portion and the surrounding wall.

In the configuration described above, in the state in which the mating connector is fitted into the hood portion, the area of the hood portion corresponding to the locking portion is inhibited from being subject to the flexural deformation toward the surrounding wall. Accordingly, robust locking between the locking portion and the mating connector is achieved.

As modes to carry out the technologies disclosed in this specification, the following modes are preferable.

The mating connector is formed with a locking projection configured to be locked with the locking portion in a state in which the mating connector is fitted into the hood portion; a depressed portion, in which the locking projection is to be stored in a state in which the mating connector is fitted thereto, is formed on the inner wall of the hood portion so as to be depressed therefrom, and the locking portion is formed on a wall portion located on the back side with respect to the fitting direction from among the wall portions which define the depressed portion.

According to the mode described above, the thickness of the hood portion is relatively thinner only in the area where the depressed portion is formed. In other words, the thickness in the area different from the depressed portion of the hood portion is thicker than the area where the depressed portion is formed. Consequently, since the locking portion can be formed without reducing the rigidity of the hood portion, the flexural deformation of the hood portion toward the surrounding wall can further be inhibited.

The synthetic resin portion includes a primary molded portion Ruined of a first synthetic resin material, and a secondary molded portion formed by molding the primary molded portion further with a second synthetic resin material, the primary molded portion includes a base wall through which the terminal fitting penetrates, an extending strip formed into a plate shape and extending from the position of the base wall near the edge portion in the direction of extension of the terminal fitting, and the locking portion formed at an end portion of the extending strip, the secondary molded portion forms the hood portion by being formed so as to be secured to the extending strip and the base wall, and has the surrounding wall and the reinforcing rib, and the reinforcing rib is configured to connect the area of the extending strip corresponding to the locking portion and the surrounding wall.

According to the mode described above, the hood portion includes the extending strip of the primary molded portion and the secondary molded portion secured to the extending strip. The extending strip is formed with the locking portion which is locked with the mating connector. When the mating connector is fitted into the interior of the hood portion, the mating connector is locked with the locking portion. At this time, a force in the direction to cause the extending strip to be flexurally deformed toward the surrounding wall from the mating connector may be applied to the extending strip formed with the locking portion. Then, there is a concern that a force is applied to a secured portion between the primary molded portion and the secondary molded portion, and hence the secured portion may become broken.

Accordingly, in this mode, the reinforcing ribs are configured to connect the area of the extending strip corresponding to the locking portion and the surrounding wall. Accordingly, the primary molded portion having the extending strip and the secondary molded portion having the surrounding wall can be connected with the reinforcing ribs, so that the secured portion between the primary molded portion and the secondary molded portion is inhibited from being broken.

By forming the reinforcing ribs at a position retracted from the distal end edge of the extending strip, the wall surface of the extending strip on the side of the surrounding wall is formed with the mold abutting surface, where the mold used when forming the secondary molded portion and the extending strip come into abutment.

According to the mode described above, when forming the secondary molded portion, the extending strip as the primary molded portion and the mold for the secondary molding may be brought into abutment with each other on the mold abutting surface. Accordingly, the second synthetic resin material is inhibited from leaking from the gap between the extending strip and the mold for the secondary molding at the time of the secondary molding.

The case is formed integrally with the connector as the secondary molded portion.

According to the mode described above, the connector and the case are formed integrally as the secondary molded portion, and hence entry of water from a gap between the connectors and the case into the case is inhibited.

The foregoing descriptions of specific embodiments have been presented for purposes of illustration and description. They are not intended to be exhaustive or to limit the invention to the precise forms disclosed, and obviously many modifications and variations are possible in light of the above teaching. The embodiments were chosen and described in order to best explain principles and practical applications of the invention, and to thereby enable others skilled in the art to best utilize the invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

The invention claimed is:

1. A connector, comprising:

a terminal fitting; and a synthetic resin portion having the terminal fitting disposed inside the synthetic resin portion, the synthetic resin portion including:

a hood portion to which a mating connector is fitted;

a surrounding wall provided on an outer periphery of the hood portion, the surrounding wall and the hood portion forming a cavity portion;

a locking portion provided on an inner wall of the hood portion and configured to lock the mating connector from a back side of the mating connector with respect to a fitting direction to restrict the mating connector from separating from the hood portion backward with respect to the fitting direction; and a reinforcing rib provided in an area between the hood portion and the locking portion and including (i) a first side formed with the hood portion and (ii) a second side formed with the surrounding wall;

wherein the synthetic resin portion includes a primary molded portion formed of a first synthetic resin material, and a secondary molded portion formed by molding the primary molded portion further with a second synthetic resin material.

2. The connector according to claim 1, wherein the mating connector has a locking projection configured to be locked with the locking portion in a state in which the mating connector is fitted into the hood portion, a depressed portion configured to store the locking projection in a state in which the mating connector is fitted inside the hood portion, the depressed portion being formed on the inner wall of the hood portion so as to be depressed from the hood portion, and the locking portion is formed on a wall portion located on the back side with respect to the fitting direction from among the wall portions which define the depressed portion.

3. The connector according to claim 1, wherein:

the primary molded portion includes a base wall through which the terminal fitting penetrates, an extending strip having a plate-like shape and extending from the position of the base wall near an edge portion in the direction that the terminal fitting extends, and the locking portion formed at an end portion of the extending strip, the secondary molded portion forms the hood portion by being formed so as to be secured to the extending strip and the base wall, and has the surrounding wall and the reinforcing rib, and the reinforcing rib is configured to connect the area of the extending strip corresponding to the locking portion and the surrounding wall.

4. The connector according to claim 3, wherein by forming the reinforcing rib at a position retracted from a distal end edge of the extending strip, the wall surface of the extending strip on the side of the surrounding wall is formed with a mold abutting surface, the mold abutting surface being a surface where a mold used when forming the secondary molded portion and the extending strip come into abutment.

5. An electric connection box comprising:

a circuit board; and a case configured to store the circuit board in the interior of the case, the case including a connector having a terminal fitting connected to the circuit board and a synthetic resin portion having the terminal fitting disposed inside of the synthetic resin portion, the synthetic resin portion including:

a hood portion to which a mating connector is fitted;

a surrounding wall provided on an outer periphery of the hood portion, the surrounding wall and the hood portion forming a cavity portion;

a locking portion provided on an inner wall of the hood portion and configured to lock the mating connector from a back side of the mating connector with respect to a fitting direction to restrict the mating connector from separating from the hood portion backward with respect to the fitting direction; and a reinforcing rib provided in an area between the hood portion and the locking portion and including (i) a first side formed with the hood portion and (ii) a second side formed with the surrounding wall;

wherein the synthetic resin portion includes a primary molded portion formed of a first synthetic resin material, and a secondary molded portion formed by molding the primary molded portion further with a second synthetic resin material.

6. The electric connection box according to claim 5, wherein the mating connector has a locking projection configured to be locked with the locking portion in a state in which the mating connector is fitted into the hood portion, the inner wall of the hood portion is formed with a depressed portion configured to store the locking projection in a state in which the mating connector is fitted inside the hood portion so as to be depressed therefrom, and the locking portion is formed on a wall portion located on the back side with respect to the fitting direction from among the wall portions which define the depressed portion.

7. The electric connection box according to claim 5, wherein:

the primary molding portion includes a base wall through which the terminal fitting penetrates, an extending strip having a plate-like shape and extending from the position of the base wall near an edge portion in the direction that the terminal fitting extends, and the locking portion formed at an end portion of the extending strip, the secondary molded portion forms the hood portion by being formed so as to be secured to the extending strip and the base wall, and has the surrounding wall and the reinforcing rib, and the reinforcing rib is configured to connect the area of the extending strip corresponding to the locking portion and the surrounding wall.

8. The electric connection box according to claim 7, wherein the case is formed integrally with the connector as the secondary molded portion.

9. The electric connection box according to claim 7, wherein by forming the reinforcing ribs at a position retracted from a distal end edge of the extending strip, the wall surface of the extending strip on the side of the surrounding wall is formed with a mold abutting surface, the mold abutting surface being a surface where a mold used when forming the secondary molded portion and the extending strip come into abutment.

10. The electric connection box according to claim 6, wherein the synthetic resin portion includes a primary molded portion formed of a first synthetic resin material, and a secondary molded portion formed by molding the primary molded portion further with a second synthetic resin material, the primary molding portion including:

a base wall through which the terminal fitting penetrates, an extending strip having a plate-like shape and extending from the position of the base wall near an edge portion in the direction that the terminal fitting extends, and the locking portion formed at an end portion of the extending strip, the secondary molded portion forms the hood portion by being formed so as to be secured to the extending strip and the base wall, and has the surrounding wall and the reinforcing rib, and the reinforcing rib is configured to connect the area of the extending strip corresponding to the locking portion and the surrounding wall.

11. The electric connection box according to claim 8, wherein by forming the reinforcing ribs at a position retracted from a distal end edge of the extending strip, the wall surface of the extending strip on the side of the surrounding wall is formed with a mold abutting surface, the mold abutting surface being a surface where a mold used when forming the secondary molded portion and the extending strip come into abutment.

12. The electric connection box according to claim 10, wherein the case is formed integrally with the connector as the secondary molded portion.

13. The electric connection box according to claim 10, wherein by forming the reinforcing ribs at a position retracted from a distal end edge of the extending strip, the wall surface of the extending strip on the side of the surrounding wall is formed with a mold abutting surface, the mold abutting surface being a surface where a mold used when forming the secondary molded portion and the extending strip come into abutment.

14. The electric connection box according to claim 12, wherein by forming the reinforcing ribs at a position retracted from a distal end edge of the extending strip, the wall surface of the extending strip on the side of the surrounding wall is formed with a mold abutting surface, the mold abutting surface being a surface where a mold used when forming the secondary molded portion and the extending strip come into abutment.

* * * * *